US009022215B2

(12) United States Patent
Glass et al.

(10) Patent No.: US 9,022,215 B2
(45) Date of Patent: May 5, 2015

(54) MULTIPACK TRANSACTION CARD HOLDER ASSEMBLY

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 120 days.

(21) Appl. No.: 13/544,546

(22) Filed: Jul. 9, 2012

(65) Prior Publication Data

US 2013/0168282 A1 Jul. 4, 2013

Related U.S. Application Data

(60) Provisional application No. 61/506,061, filed on Jul. 9, 2011.

(51) Int. Cl.

| | |
|---|---|
| ***B65D 85/48*** | (2006.01) |
| ***B65D 73/00*** | (2006.01) |
| ***B42D 15/04*** | (2006.01) |

(52) U.S. Cl.
CPC ..... *B65D 73/00* (2013.01); *B65D 73/0028* (2013.01); *B42D 15/045* (2013.01)

(58) Field of Classification Search
USPC ..... 206/449, 232, 460–470; 235/379
See application file for complete search history.

(56) References Cited

U.S. PATENT DOCUMENTS

| | | | | |
|---|---|---|---|---|
| 4,905,824 | A * | 3/1990 | Stevens | 206/215 |
| 6,244,444 | B1 * | 6/2001 | Jacobus et al. | 206/703 |
| 6,957,737 | B1 * | 10/2005 | Frederickson et al. | 206/449 |
| 7,219,829 | B2 * | 5/2007 | Treat | 229/92.8 |
| 7,374,095 | B2 * | 5/2008 | Blank et al. | 235/486 |
| 8,181,789 | B1 * | 5/2012 | Casella et al. | 206/768 |
| 2009/0218408 | A1 * | 9/2009 | Biskupski et al. | 206/39 |

* cited by examiner

*Primary Examiner* — Mickey Yu
*Assistant Examiner* — Chun Cheung
(74) *Attorney, Agent, or Firm* — Polsinelli PC

(57) ABSTRACT

An assembly for holding multiple transaction card holders and associated multiple transaction cards in a single packet for display.

9 Claims, 7 Drawing Sheets

MULTIPACK TRANSACTION CARD HOLDER ASSEMBLY

CROSS REFERENCE TO RELATED APPLICATIONS

This application claims the benefit of the prior filed, provisional application Ser. No. 61/506,061, filed Jul. 9, 2011, incorporated by reference herein.

BACKGROUND OF THE INVENTION

This invention relates generally to transaction or gift card holders and more particularly to an assembly for holding multiple gift card holders in a single packet while taking no more display space than typically allotted for a single gift card mounted on a backer.

Transaction cards, stored value cards, or gift cards, as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or, more commonly, is selected at the point of sale by the purchaser and loaded by the cashier using a magnet card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets are typically required to fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

What is needed, therefore, is a device capable of holding multiple gift card holders and associated gift cards in a single packet within the allotted display space, thereby increasing the value relative to price for the purchaser and increasing the value and price relative to space for the merchant displaying and selling embodiments thereof.

BRIEF DESCRIPTION OF THE INVENTION

The purpose of this invention is to provide an assembly for holding multiple gift card holders in a single packet while taking no more display space than typically allotted for a single gift card mounted on a backer. The assembly includes a backer for supporting multiple transaction cards, e.g. gift cards, and for supporting a gift card holder sub-packet comprising a corresponding number of multiple gift card holders.

The assembly may also include a case for enclosing the assembly components for display upon a display rack or stand.

An embodiment of the assembly may include a backer with multiple transaction cards supported upon the backer. A gift card holder sub-packet comprising multiple gift card holders corresponding in number to the number of transaction cards is also supported upon the backer. A case encloses the transaction cards, the transaction card holders and at least a portion of the backer. A backer tab extends from the backer to pass through an aperture in the case to further extend outside of the case. The backer tab may include purchase indicia or other indicia or messages. The backer tab is defined from the main body of the backer by notches extending transversely into the backer. The case is generally closed along the perimeter thereof, including portions of the case that lie within the notches, but not including along the portion of the case through which the neck of the backer tab extends. The assembly includes adhesive strips (e.g. removable adhesive) or other means for attaching or adhering the transaction cards to the backer and similar means for adhering the holders to the backer.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
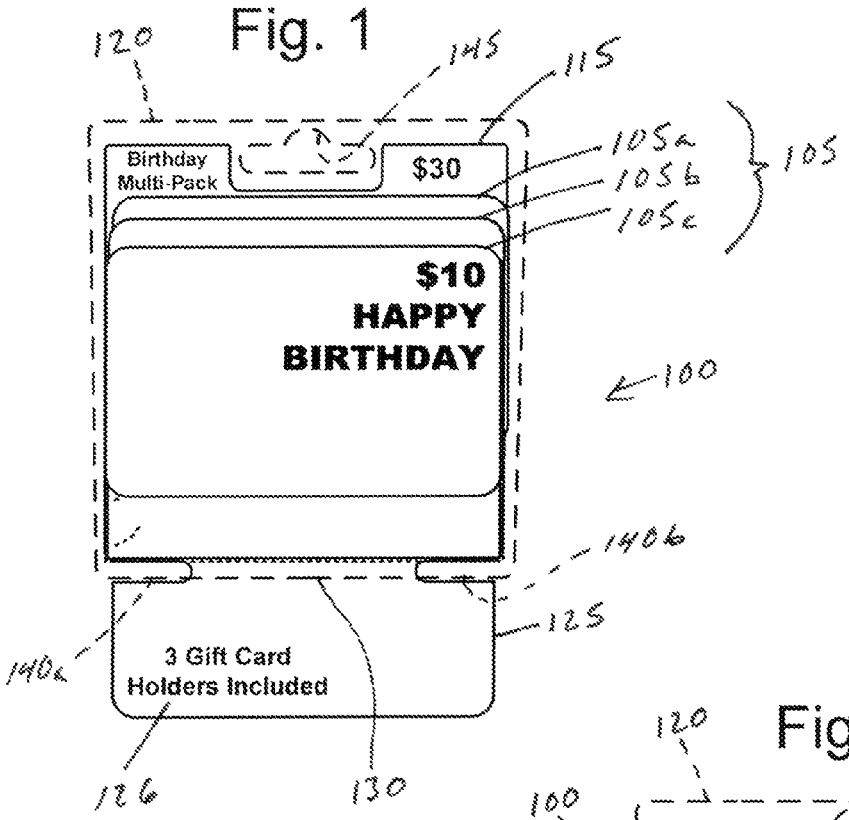
FIG. 1 is a front view of an assembly for holding multiple gift card holders and a corresponding number of gift cards in a single display packet.

With reference to the figures, FIGS. 1-14 are illustrations of various embodiments of a multipack gift card holder assembly 100. FIG. 1 is a front view of the assembly 100 showing multiple transaction cards, such as gift cards 105*a*, 105*b* and 105*c* (referred to collectively herein by 105), attached to the front flap 110 of a backer 115 and visible through, and enclosed within, a transparent enclosure or case 120 indicated in large broken lines. The backer 115 typically comprises a heavy paper material such as cardstock or cardboard known in the prior art for use with product packaging and display. The case 120, of a type generally known as a clamshell case, typically comprises a clear plastic material also known in the prior art for product packaging and display.

Figure 2:
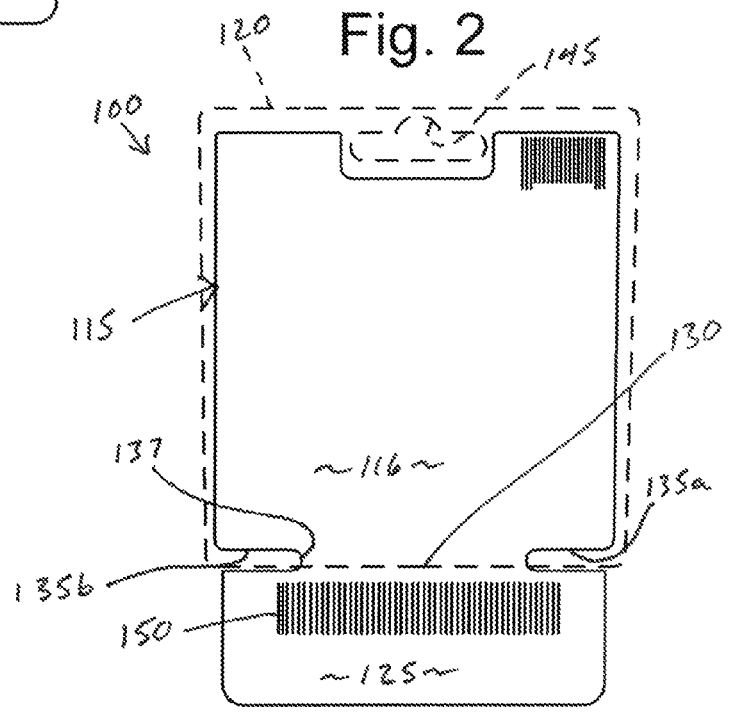
FIG. 2 is a rear view of the assembly.

FIG. 2 is a rear view of the assembly 100 showing the rear surface of the backer 115. In both FIGS. 1 and 2, a tab portion (backer tab 125) of the backer 115 may be seen projecting downward and exiting through a first aperture or slot 130 in the lower margin of the case 120. The tab 125 is partially separated or defined from the main body 116 of the backer 115 by notches 135*a* and 135*b* (referred to collectively herein by 135) transversely located on either side of the tab 125 at the interstice or neck 137 between the tab 125 and the main body 116. Closed portions 140*a* and 140*b* of the bottom margin of the case 120 lie within the notches 135 and provide support for the main body 116 so that it cannot pass through the slot 130. The tab 125 may include indicia, such as purchase indicia, such as one or more barcodes 150, or other identifiers, indicia or messages 126. Because the tab 125 extends outside the case 120, barcodes or other indicia thereon may be more readily accessed for scanning, e.g. at the point of purchase. The case 120 is provided with a second aperture or hole 145, such as the sombrero-cut hole 145 shown in the figures, proximate the top margin of the case 120 for receiving the peg or J-hook of a display stand (not shown). Preferably, the hole 145 has dimensions of ~1.875" wide by ~0.5" high and is placed ~0.1875" from the top of the packet.

The assembly 100 shown in FIGS. 1 and 2 is preferably comprised of components sized to yield an assembled unit or assembly 100 having outer dimensions not exceeding 5.25" tall by 4" wide so that the assembly 100 may fit within a set, allocated space in a pre-existing display according to dimensions complying with industry standards.

Figure 3:
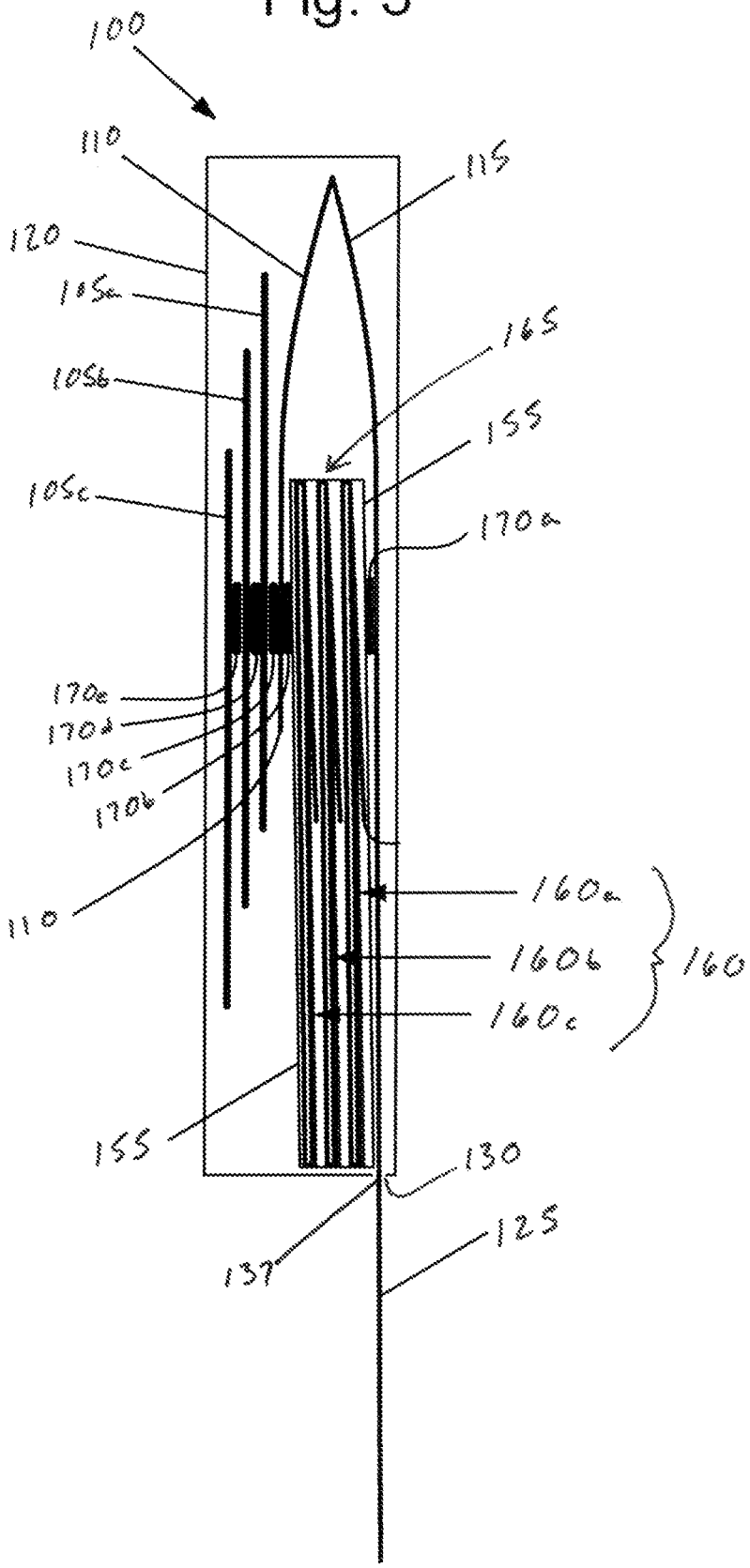
FIG. 3 is a diagram of the assembly drawn from a right side view.

FIG. 3 is a diagram of the assembly 100 drawn from a right side view with reference to FIG. 1. The relative dimensions of some components have been exaggerated for clarity. The assembled components may be observed in FIG. 3, as follows. Three gift card holders 160*a*, 160*b* and 160*c* (referred to collectively herein as 160), described in greater detail below, are aligned and stacked one upon the other and covered in a wrap 155, such as a clear plastic wrap (e.g. shrink-wrap), to form an assembled gift card holder sub-packet 165. The wrap 155 is typically heat-sealed or heat-shrinked to close.

The sub-packet 165 is attached to the front surface of the main body 116 of the backer 115 using a strip of removable adhesive (referred to herein as a "strip") 170*a* or other operable means placed between the back surface of the sub-packet 165 and the front surface of the main body 116. Another strip 170*b* is placed between the front surface of the packet 165 and the back surface of the flap 110 of the backer 115. A first gift card 105*a* is attached to the front surface of the flap 110 by placing a strip 170*c* between the back surface of the card 105*a* and the front surface of the flap 110. Two additional cards 105*b* and 150*c* are attached in sequence to the first card 105 in a similar manner using adhesive strips 170*d* and 170*e*, as shown. The assembled components are then enclosed in the case 120, which is typically formed of two panels of clear plastic material that are joined to one another around their margins by heat-sealing.

Figure 4:
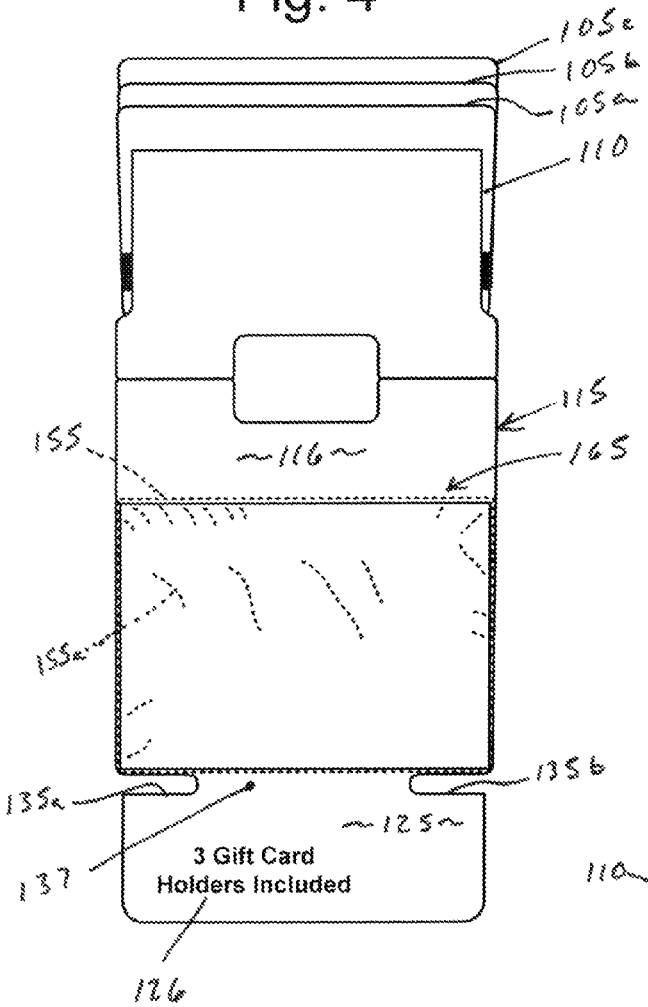
FIG. 4 is a front view of assembly components removed from the enclosure or case with the backer flap lifted to reveal a sub-packet of gift card holders shrink-wrapped and adhered to the backer.
Figure 5:
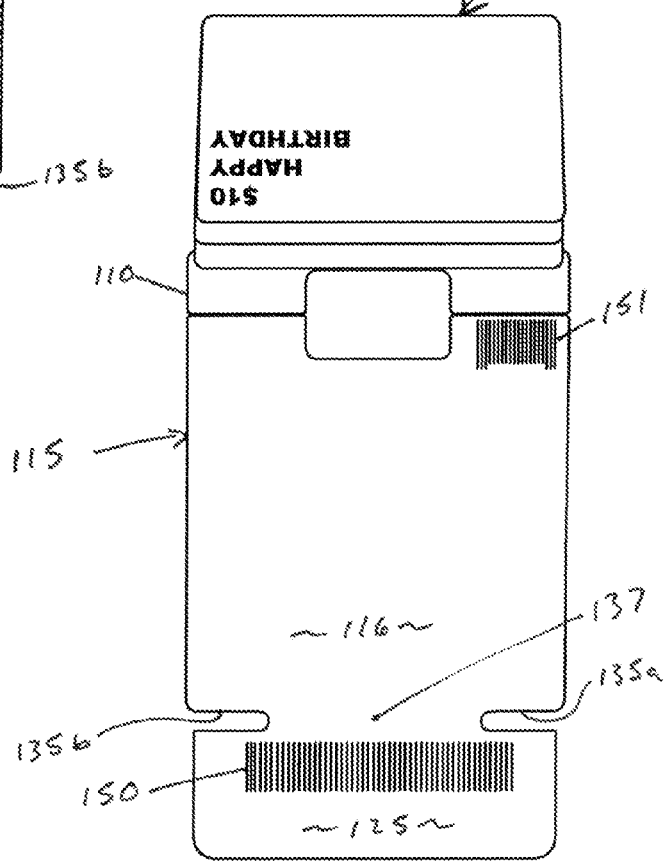
FIG. 5 is a rear view of the assembly of FIG. 4.
Figure 7:
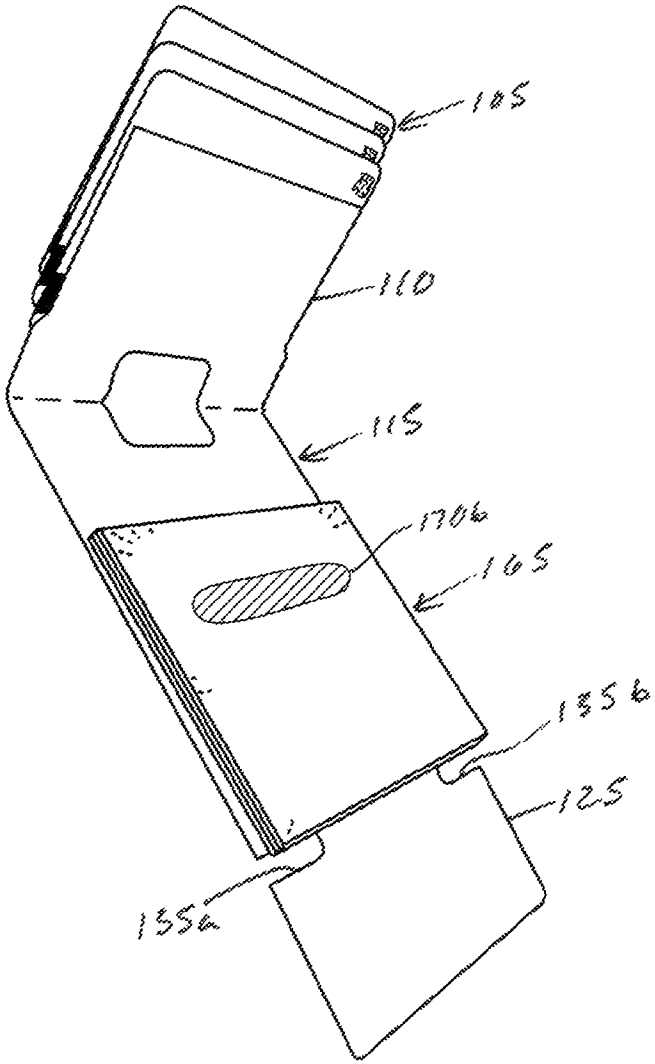
FIG. 7 is a left, front perspective view of the assembly of FIG. 6.
Figure 6:
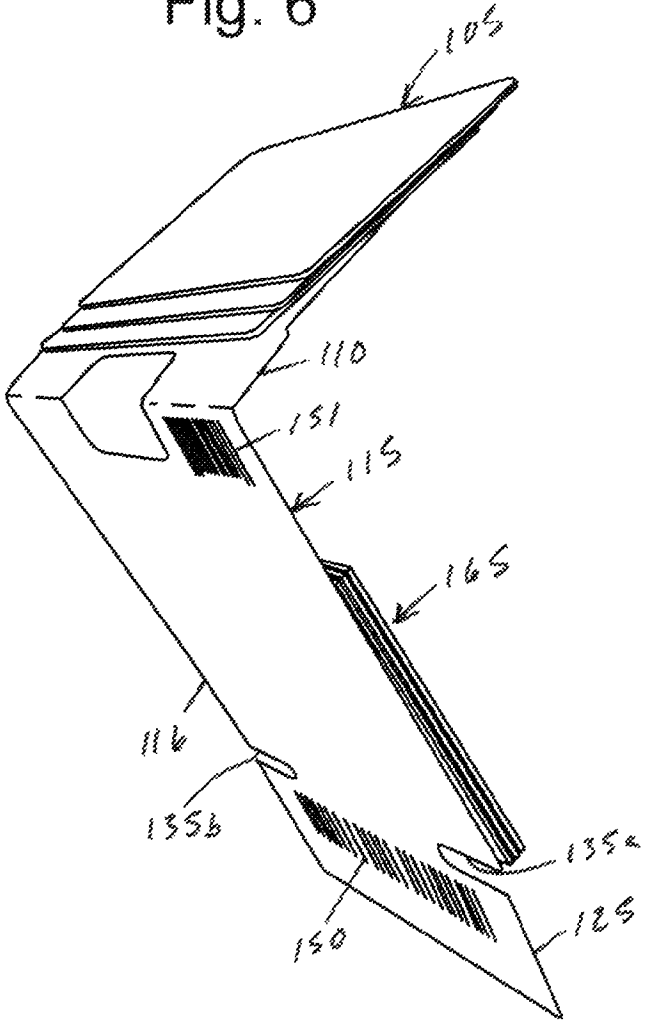
FIG. 6 is a left, rear perspective view of the assembly of FIG. 5.

FIG. 4 is a front view showing assembly components removed from the case 120 and with the backer flap 110 lifted to reveal the sub-packet 165 of gift card holders 160 adhered to the backer main body 116. In some embodiments, the sub-packet 165 is shrink-wrapped to facilitate adhering the sub-packet 165 to the backer main body 116 as a unit. Wrap 155 is indicated in small broken lines around the perimeter of the sub-packet 165 (and also by lines 155*a* indicating small wrinkles in the surface of the wrap). In other embodiments, the gift card holders 160*a*, 160*b* and 160*c* are held together and against the main body 116 by pressure exerted thereon by the enclosing case 120, in which case the holder 160 rest upon the closed portions 140 of the case 120 (see FIG. 1). FIG. 5 is a rear view of the assembly of FIG. 4 showing barcode indicia 150 on the rear surface of the tab 125 and a UPC barcode 151 on the rear surface of the main body 116. FIG. 6 is a left, rear perspective view of the assembly components shown in FIGS. 4 and 5. FIG. 7 is a left, front perspective view of the assembly components shown in FIGS. 4 through 6.

Figures 8, 9:
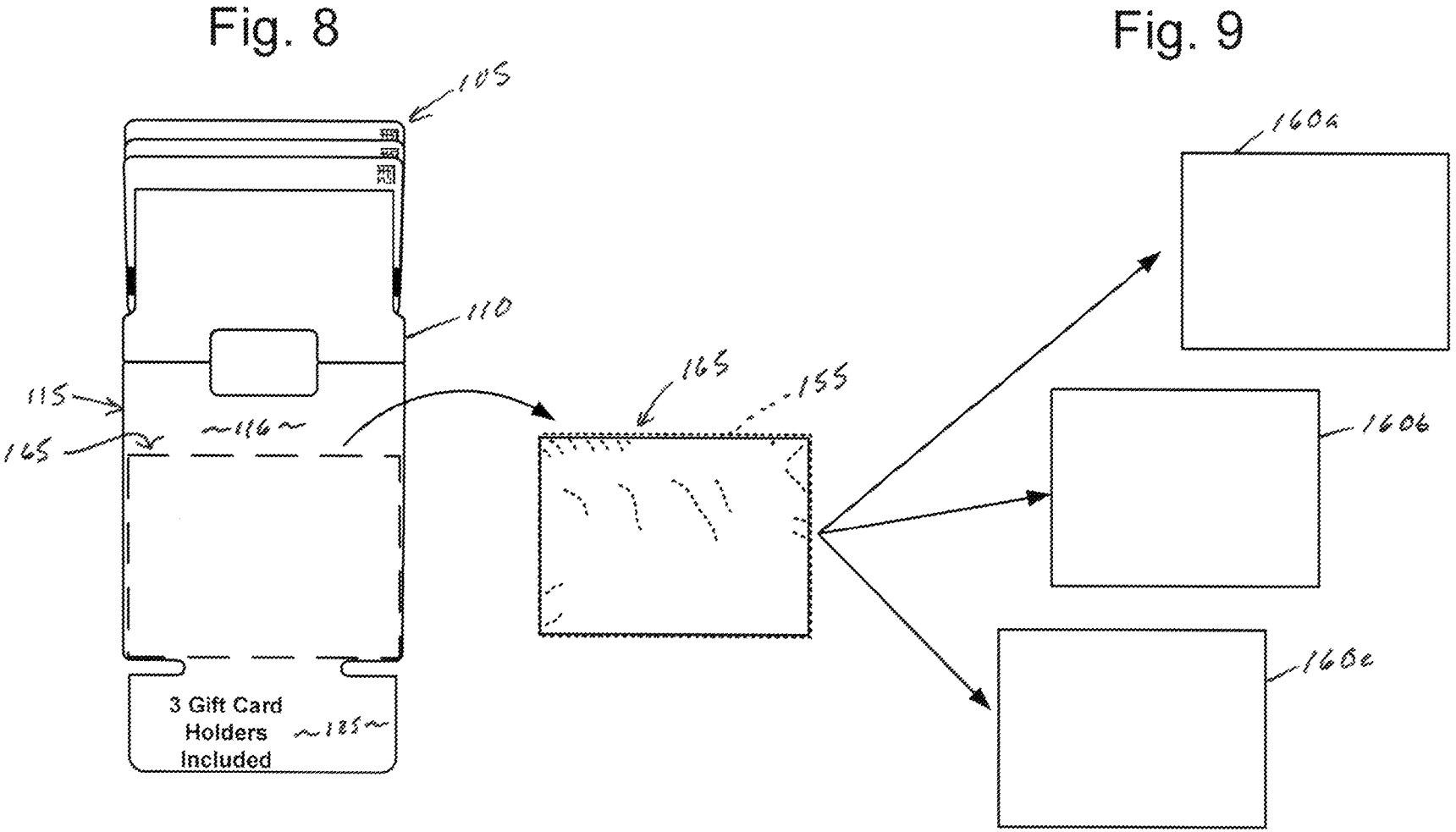
FIG. 8 is a front view of the holder sub-packet removed from the backer.
FIG. 9 is a front view of the multiple holders removed from the sub-packet.

FIG. 8 is a front view showing the sub-packet 165 removed from the main body 116 of the backer 115. FIG. 9 is a front view of each of the gift card holders 160 when removed disassembled from the sub-packet 165 by removing the sub-packet wrap 155.

Figure 10:
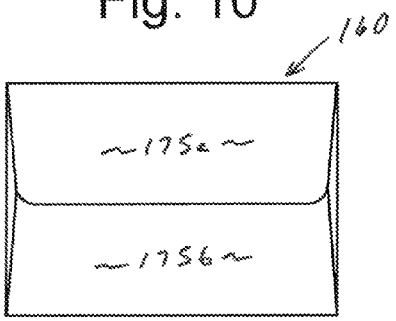
FIG. 10 is a rear view of a holder.
Figure 11:
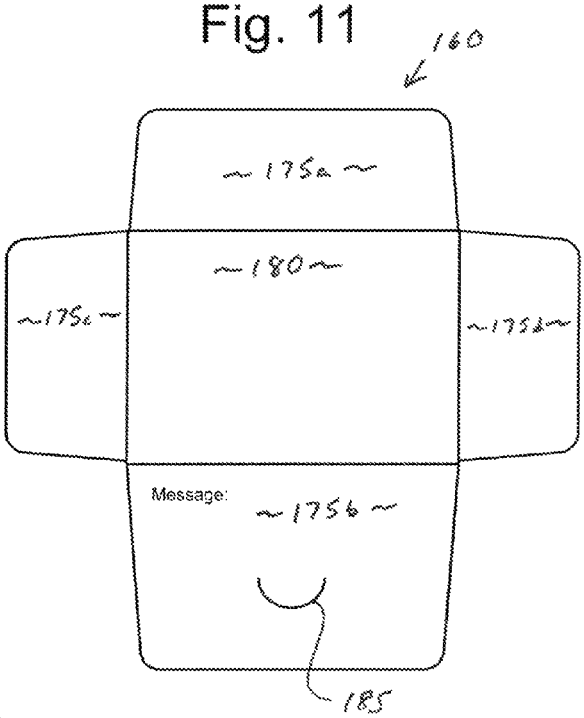
FIG. 11 is a rear view of a holder showing the top flap, bottom flap and side flaps in opened positions to reveal the interior surface of the holder center panel.
Figure 12:
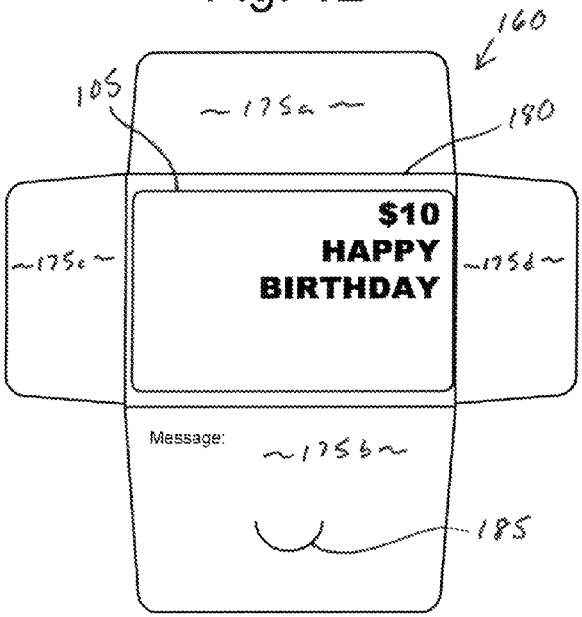
FIG. 12 is a rear view of the holder of FIG. 11 showing a gift card positioned upon the interior surface of the center panel.

FIG. 10 is a rear view of a gift card holder 160 in a closed position as when packaged for display and sale. FIG. 11 is a rear view of a holder 160 showing the top flap 175*a*, bottom flap 175*b* and side flaps 175*c* and 175*d* in opened positions to reveal the interior surface of the holder center panel 180. FIG. 12 is a rear view of the holder 160 showing a gift card 105 positioned upon the interior surface of the center panel 180.

Figure 13:
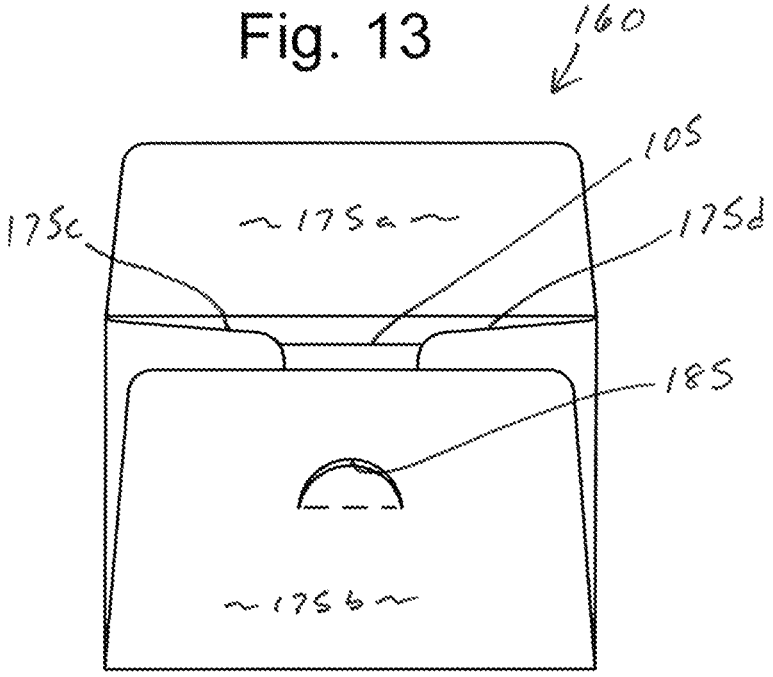
FIG. 13 is a rear view of the holder of FIG. 12 showing the side flaps and bottom flaps in closed positions to substantially enclose the gift card positioned upon the center panel.
Figure 14:
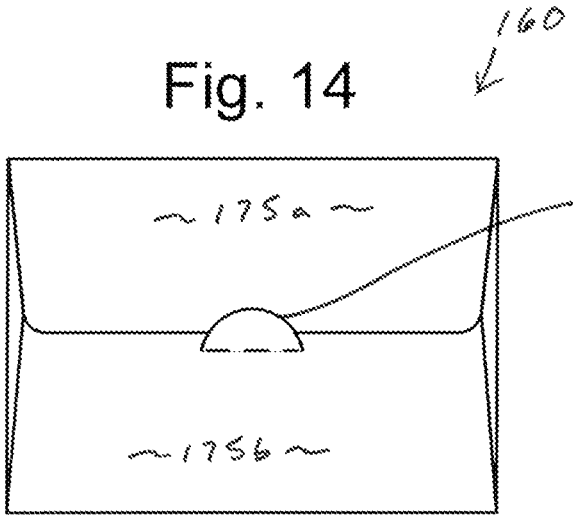
FIG. 14 is a rear view of the holder of FIG. 13 showing the top flap in a closed position, the leading, distal, outer edge of which is inserted into and engaged with a slit in the bottom flap.

FIG. 13 is a rear view of the holder 160 showing the side flaps 175*c* and 175*d* and bottom flap 175*b* in closed positions to substantially enclose the gift card 105 positioned upon the center panel 180. FIG. 14 is a rear view of the holder 160 showing the top flap 175*a* in a closed position, the leading, distal, outer edge of which is inserted into and engaged with a slit 185 in the bottom flap 175*b*, the slit 185 forming a closure tab 186 for retaining the top flap 175*a* in a closed position. Each of the holders 160 may thereby be used to retain and hold an associated gift card 105 for presentation of the gift card 105 to a recipient.

Therefore, as shown and described herein, the assembly 100 provides an apparatus and method for packaging, displaying and selling multiple gift cards and associated gift card holders within a space typically assigned to display only a single gift card or holder, thereby greatly increasing the value of the merchandise presented for sale within a defined space.

Having thus described the invention, what is claimed as new and desired to be secured by Letters Patent is:

1. A multipack gift card holder assembly comprising:

a backer;

a flap hingedly engaged to the backer, the flap including a front flap surface and a back flap surface;

multiple transaction cards supported upon a front flap surface of said flap;

a gift card holder sub-packet comprising multiple gift card holders corresponding in number to the number of said transaction cards, said sub-packet supported upon a front backer surface of said backer; and a case enclosing said transaction cards, said gift card holders, said flap, and at least a portion of said backer.

2. The assembly of claim 1, wherein a backer tab extends from said backer to pass through an aperture in said case to extend outside of said case.

3. The assembly of claim 1, wherein said transaction cards are removable engaged to said flap by an adhesive.

4. The assembly of claim 1, wherein said gift card holder sub-packet is removable engaged to said front backer surface by an adhesive.

5. The assembly of claim 2, wherein said backer tab includes purchase indicia.

6. The assembly of claim 2, wherein said backer tab is defined from a main body of said backer by notches extending transversely into said backer.

7. The assembly of claim 6, wherein closed portions of said case lie within said notches.

8. The assembly of claim 1, wherein said sub-packet is wrapped.

9. The assembly of claim 4, wherein said gift card holder sub-packet is further removably engaged to said back flap surface by another adhesive.

* * * * *